US010818225B2

(12) United States Patent
Xuan et al.

(10) Patent No.: US 10,818,225 B2
(45) Date of Patent: Oct. 27, 2020

(54) PIXEL CIRCUIT, PIXEL DRIVING METHOD AND DISPLAY DEVICE

(71) Applicant: BOE TECHNOLOGY GROUP CO., LTD., Beijing (CN)

(72) Inventors: Minghua Xuan, Beijing (CN); Shengji Yang, Beijing (CN); Lei Wang, Beijing (CN); Li Xiao, Beijing (CN); Jie Fu, Beijing (CN); Xiaochuan Chen, Beijing (CN); Pengcheng Lu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 388 days.

(21) Appl. No.: 15/775,889

(22) PCT Filed: Nov. 15, 2017

(86) PCT No.: PCT/CN2017/111134

§ 371 (c)(1),
(2) Date: May 14, 2018

(87) PCT Pub. No.: WO2018/214419

PCT Pub. Date: Nov. 29, 2018

(65) Prior Publication Data

US 2020/0302863 A1 Sep. 24, 2020

(30) Foreign Application Priority Data

May 26, 2017 (CN) ..... 2017 1 0384767

(51) Int. Cl.
*G09G 3/3233* (2016.01)

(52) U.S. Cl.
CPC ... *G09G 3/3233* (2013.01); *G09G 2300/0426* (2013.01); *G09G 2320/0233* (2013.01);
(Continued)

(58) Field of Classification Search
None
See application file for complete search history.

(56) References Cited

U.S. PATENT DOCUMENTS

2006/0132053 A1 6/2006 Cho et al.
2010/0013868 A1* 1/2010 Chung ..... G09G 3/3233 345/690

(Continued)

FOREIGN PATENT DOCUMENTS

CN 1851546 10/2006
CN 101276542 A 10/2008

(Continued)

OTHER PUBLICATIONS

Second Office Action for CN Application No. 201710384767.2, dated Feb. 22, 2019.

(Continued)

*Primary Examiner* — Dorothy Harris
(74) *Attorney, Agent, or Firm* — Dinsmore & Shohl LLP

(57) ABSTRACT

A pixel circuit is disclosed, which includes: a driving transistor, a capacitor, a data writing sub-circuit and a current controlling sub-circuit, wherein the current controlling sub-circuit is used for controlling a ratio of a total time during which the driving current flows into the current controlling sub-circuit to a total time during which the driving current flows into the light-emitting device under control of a second control signal inputted via a second control signal input line during a light-emitting stage. Moreover, a pixel driving method and a display device are disclosed.

19 Claims, 3 Drawing Sheets

(52) U.S. Cl.
CPC ..... *G09G 2320/0252* (2013.01); *G09G 2330/028* (2013.01)

(56) References Cited

U.S. PATENT DOCUMENTS

| | | | | |
|---|---|---|---|---|
| 2011/0102403 | A1* | 5/2011 | Kim | G09G 3/3233 345/211 |
| 2012/0001896 | A1* | 1/2012 | Han | G09G 3/3233 345/214 |
| 2013/0127802 | A1 | 5/2013 | Yamashita et al. | |
| 2016/0189610 | A1* | 6/2016 | Xiao | G09G 3/3233 345/77 |
| 2016/0260380 | A1* | 9/2016 | Yang | G09G 3/32 |
| 2018/0268756 | A1* | 9/2018 | Kasai | G09G 3/3258 |
| 2018/0315374 | A1* | 11/2018 | Zhang | G09G 3/3258 |

FOREIGN PATENT DOCUMENTS

| | | | | |
|---|---|---|---|---|
| CN | 101859791 | A | | 10/2010 |
| CN | 102054428 | A | * | 5/2011 |
| CN | 102122490 | A | | 7/2011 |
| CN | 102682704 | A | | 9/2012 |
| CN | 103594059 | A | | 2/2014 |
| CN | 104103239 | A | | 10/2014 |
| CN | 106097964 | A | | 11/2016 |
| CN | 106409233 | A | * | 2/2017 |
| CN | 106486041 | A | | 3/2017 |
| CN | 107038997 | A | | 8/2017 |

OTHER PUBLICATIONS

First Office Action for CN Application No. 201710384767.2, dated Sep. 27, 2018.
International Search Report and Written Opinion for International Appl. No. PCT/CN2017/111134, dated Feb. 22, 2018.

* cited by examiner

PIXEL CIRCUIT, PIXEL DRIVING METHOD AND DISPLAY DEVICE

CROSS-REFERENCE TO RELATED APPLICATIONS

The present application claims priority under 35 U.S.C. § 371 to International Patent Application No. PCT/CN2017/111134, filed on Nov. 15, 2017, which claims priority to Chinese Patent Application No. 201710384767.2 filed on May 26, 2017, the disclosure of each of which is incorporated herein in entirety by reference.

TECHNICAL FIELD

The present disclosure relates to a pixel circuit, a pixel driving method and a display device.

BACKGROUND

In an existing pixel driving circuit, in general, a data voltage is inputted to a driving transistor, such that the driving transistor would generate a corresponding driving current to drive the display device to emit light.

SUMMARY

Some embodiments provide a pixel circuit, comprising: a driving transistor, a capacitor, a data writing sub-circuit, a current controlling sub-circuit and a light-emitting device, wherein:

the data writing sub-circuit is connected to a first end of the capacitor, a second end of the capacitor is connected to a control electrode of the driving transistor, a first electrode of the driving transistor is connected to a first power supply end, a second electrode of the driving transistor is connected to a first electrode of the light-emitting device, the current controlling sub-circuit is connected to the first electrode of the light-emitting device and a second power supply end, and a second electrode of the light-emitting device is connected to the second power supply end;

the data writing sub-circuit is used for writing a data voltage supplied via a data line into the first end of the capacitor under control of a first control signal inputted via a first control signal input line during a data writing stage;

the driving transistor is used for generating a driving current under control of a voltage at the second end of the capacitor during a light-emitting stage;

the current controlling sub-circuit is used for controlling a ratio of a total time during which the driving current flows into the current controlling sub-circuit to a total time during which the driving current flows into the light-emitting device under control of a second control signal inputted via a second control signal input line during the light-emitting stage.

Optionally, the light-emitting stage includes: several light-emitting sub-stages and non-light-emitting sub-stages which are alternately arranged;

the current controlling sub-circuit is used for writing, during the non-light-emitting sub-stages, a second voltage supplied by the second power supply end into the first electrode of the light-emitting device such that the driving current flows into the current controlling sub-circuit.

Optionally, the pixel circuit further comprises a resetting sub-circuit, which is connected to both the first end and the second end of the capacitor;

wherein the resetting sub-circuit is used for resetting the first end and the second end of the capacitor under control of a reset control signal inputted via a reset control signal input line during a reset stage.

Optionally, the resetting sub-circuit comprises: a first transistor and a second transistor;

wherein a control electrode of the first transistor is connected to the reset control signal input line, a first electrode of the first transistor is connected to a third power supply end, and a second electrode of the first transistor is connected to the second end of the capacitor; and wherein a control electrode of the second transistor is connected to the reset control signal input line, a first electrode of the second transistor is connected to a fourth power supply end, and a second electrode of the second transistor is connected to the first end of the capacitor.

Optionally, the pixel circuit further comprises a threshold compensating sub-circuit which is connected to the second end of the capacitor and the second electrode of the driving transistor;

wherein the threshold compensating sub-circuit is used for writing a sum of a threshold voltage of the driving transistor and a first voltage supplied by the first power supply end into the second end of the capacitor under control of the first control signal inputted via the first control signal input line during a threshold compensating stage.

Optionally, the threshold compensating sub-circuit comprises: a third transistor;

wherein a control electrode of the third transistor is connected to the first control signal input line, a first electrode of the third transistor is connected to the second end of the capacitor, and a second electrode of the third transistor is connected to the second electrode of the driving transistor.

Optionally, the pixel circuit further comprises a light-emitting controlling sub-circuit which is provided between the second electrode of the driving transistor and the first electrode of the light-emitting device;

wherein the light-emitting controlling sub-circuit is used for conducting the first electrode of the driving transistor with the first electrode of the light-emitting device under control of a light-emitting controlling signal inputted via a light-emitting controlling signal input line during the light-emitting stage.

Optionally, the light-emitting controlling sub-circuit comprises: a fourth transistor;

wherein a control electrode of the fourth transistor is connected to the light-emitting controlling signal input line, a first electrode of the fourth transistor is connected to the first electrode of the driving transistor, and a second electrode of the fourth transistor is conducted with the first electrode of the light-emitting device.

Optionally, the pixel circuit further comprises a voltage stabilizing sub-circuit which is connected to the first end of the capacitor;

wherein the voltage stabilizing sub-circuit is used for writing a fifth voltage supplied by a fifth power supply end into the first end of the capacitor under control of a third control signal inputted via a third control signal input line during the light-emitting stage.

Optionally, the voltage stabilizing sub-circuit comprises: a fifth transistor;

wherein a control electrode of the fifth transistor is connected to the third control signal input line, a first electrode of the fifth transistor is connected to the fifth power supply end, and a second electrode of the fifth transistor is connected to the first end of the capacitor.

Optionally, the data writing sub-circuit comprises: a sixth transistor;

wherein a control electrode of the sixth transistor is connected to the first control signal input line, a first electrode of the sixth transistor is connected to the data line, and a second electrode of the sixth transistor is connected to the first end of the capacitor.

Optionally, the current controlling sub-circuit comprises: a seventh transistor;

wherein a control electrode of the seventh transistor is connected to the second control signal line, a first electrode of the seventh transistor is connected to the second power supply end, and a second electrode of the seventh transistor is connected to the first electrode of the light-emitting device.

Optionally, the driving transistor is a P-type transistor, the first electrode of the driving transistor is a source electrode of the P-type transistor, and the second electrode of the driving transistor is a drain electrode of the P-type transistor.

Optionally, the driving transistor is an N-type transistor, the first electrode of the driving transistor is a drain electrode of the N-type transistor, and the second electrode of the driving transistor is a source electrode of the N-type transistor.

Optionally, the light-emitting device is an organic light-emitting diode, the first electrode of the light-emitting device is an anode of the organic light-emitting diode, and the second electrode of the light-emitting device is a cathode of the organic light-emitting diode.

Optionally, the pixel circuit comprises a driving transistor, a capacitor, a data writing sub-circuit, a current controlling sub-circuit, a light-emitting device, a resetting sub-circuit, a threshold compensating sub-circuit, a light-emitting controlling sub-circuit and a voltage stabilizing sub-circuit; wherein:

the resetting sub-circuit comprises a first transistor and a second transistor;

a control electrode of the first transistor is connected to a reset control signal input line, a first electrode of the first transistor is connected to a third power supply end, and a second electrode of the first transistor is connected to a second end of the capacitor;

a control electrode of the second transistor is connected to the reset control signal input line, a first electrode of the second transistor is connected to a fourth power supply end, and a second electrode of the second transistor is connected to a first end of the capacitor;

the threshold compensating sub-circuit comprises a third transistor, wherein a control electrode of the third transistor is connected to the first control signal input line, a first electrode of the third transistor is connected to the second end of the capacitor, and a second electrode of the third transistor is connected to the second electrode of the driving transistor;

the light-emitting controlling sub-circuit comprises a fourth transistor, wherein a control electrode of the fourth transistor is connected to the light-emitting controlling signal input line, a first electrode of the fourth transistor is connected to the first electrode of the driving transistor, and a second electrode of the fourth transistor is conducted with the first electrode of the light-emitting device;

the voltage stabilizing sub-circuit comprises a fifth transistor, wherein a control electrode of the fifth transistor is connected to the third control signal input line, a first electrode of the fifth transistor is connected to the fifth power supply end, and a second electrode of the fifth transistor is connected to the first end of the capacitor;

the data writing sub-circuit comprises a sixth transistor, wherein a control electrode of the sixth transistor is connected to the first control signal input line, a first electrode of the sixth transistor is connected to the data line, and a second electrode of the sixth transistor is connected to the first end of the capacitor;

the current controlling sub-circuit comprises a seventh transistor, wherein a control electrode of the seventh transistor is connected to the second control signal line, a first electrode of the seventh transistor is connected to the second power supply end, and a second electrode of the seventh transistor is connected to the first electrode of the light-emitting device.

In addition, some embodiments provide a pixel driving method, which is based on the above-mentioned pixel circuit;

the pixel driving method comprising:

writing, by the data writing sub-circuit, a data voltage supplied via a data line into a first end of the capacitor under control of a first control signal inputted via a first control signal input line during a data writing stage;

generating, by the driving transistor, a driving current under control of a voltage at a second end of the capacitor, and controlling, by the current controlling sub-circuit, a ratio of a total time during which the driving current flows into the current controlling sub-circuit to a total time during which the driving current flows into the light-emitting device under control of a second control signal inputted via a second control signal input line, during the light-emitting stage.

Optionally, when the light-emitting stage includes several light-emitting sub-stages and non-light-emitting sub-stages which are alternately arranged:

during the non-light-emitting sub-stages in the light-emitting stage, the current controlling sub-circuit, under control of the second control signal inputted via the second control signal input line, writes a second voltage supplied by the second power supply end into a first electrode of the light-emitting device, such that the driving current flows into the current controlling sub-circuit so as to control the light-emitting device not to emit light.

In addition, some embodiments provide a display device, comprising: the pixel circuit as mentioned above.

DETAILED DESCRIPTION

Figure 1:
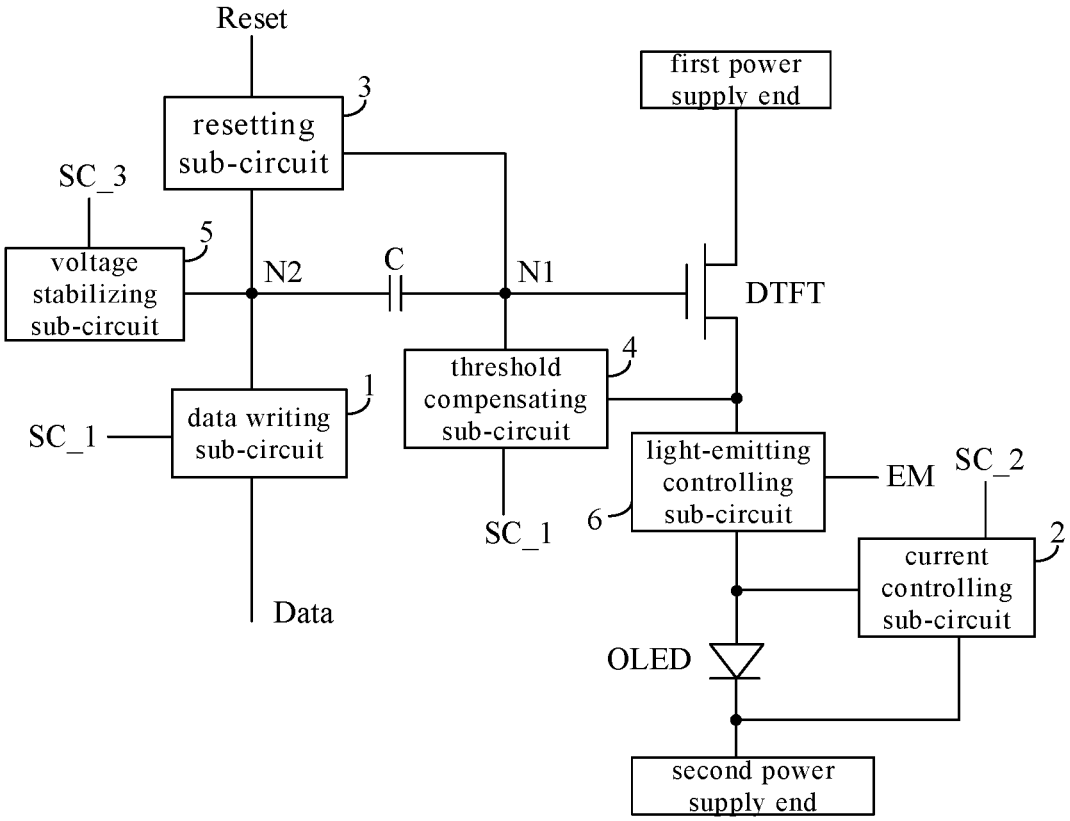
FIG. 1 is a schematic diagram showing a circuit structure of a pixel circuit provided by exemplary embodiments of the present disclosure.

In order to enable those skilled in the art to better understand the technical solution of the present disclosure, the pixel circuit, the pixel driving method and the display device provided by the present disclosure will be described in detail below with reference to the drawings.

In a pixel driving circuit, in order to generate different data voltages, a number of sets of Gamma data are needed, so that the amount of data processing is large, which occupies a large area on the drive chip, and a long time period is necessary for adjusting the Gamma when the display panel is delivered.

In addition, in the existing pixel driving circuit, during a non-light-emitting stage, a drain current may flow through the light-emitting device, so that the light-emitting device would emit weak light, i.e., when the display panel is in a black state, it still has certain brightness, such that the display panel has a low contrast.

The present disclosure aims at solving at least one of the technical problems existing in the prior art, and thus proposes a pixel circuit, a pixel driving method and a display panel.

The present disclosure has the following advantageous effects:

The present disclosure provides a pixel circuit, a pixel driving method and a display device, wherein the pixel circuit may adjust, by a current controlling sub-circuit, a ratio of a total time during which the driving current flows into the current controlling sub-circuit to a total time during which the driving current flows into the light-emitting device during the light-emitting stage, without change of the data voltage inputted via the data line, so as to adjust the visual brightness of the light-emitting device. The technical solution of the present disclosure can effectively decrease the amount of Gamma data in the drive chip and increase the data processing speed of the drive chip.

In addition, the current controlling sub-circuit can effectively avoid erroneous light emission of the light-emitting device during a non-light-emitting stage.

In the present disclosure, the term "a circuit" or "a sub-circuit" may comprise, but not limited to, electronic devices such as a resistor, a capacitor, a diode and so on.

The transistor employed in the embodiments of the present disclosure may be a thin film transistor or a field effect transistor or any other device having the same or similar properties. The source electrode and drain electrode of the transistor as employed are symmetric to each other, so there is no difference between the source electrode and the drain electrode thereof. In the embodiments of the present disclosure, in order to distinguish the source electrode and the drain electrode of the transistor, one electrode thereof is called a first electrode, and the other is called a second electrode, and the gate electrode is called a control electrode. Further, depending on the properties of the transistor, the transistor is classified into a N-type transistor and a P-type transistor. The following embodiments take a P-type transistor as an example for the illustration. When the P-type transistor is employed, the first electrode is the source electrode of the P-type transistor, and the second electrode is the drain electrode of the P-type transistor, and when a low level voltage signal is inputted to the gate electrode, the source electrode and the drain electrode are conducting. The case for the N-type transistor is to the contrary. It is conceivable that those skilled in the art can easily envisage without spending any inventive effort using the N-type transistor, which also falls into the protection scope of the embodiments of the present disclosure.

The light-emitting device in the present disclosure is a current-driving light-emitting device. In the present disclosure, an organic light-emitting diode is employed as an example of the light-emitting device for description, which would not limit the technical solution of the present disclosure.

In addition, in the present disclosure, a term "light-emitting brightness" refers to real brightness of the light emitted when the light-emitting device is lit; a term "visual brightness" refers to brightness of light emitted by the light-emitting device as perceived by the user, for example, brightness of light emitted by the light-emitting device as perceived by the user with given environmental factors such as observation distance, ambient light and observation angle of view.

Embodiment I

FIG. 1 is a schematic diagram showing a circuit structure of a pixel circuit provided by exemplary embodiments of the present disclosure. As shown in FIG. 1, the pixel circuit includes: a driving transistor DTFT, a capacitor C, a data writing sub-circuit 1, a current controlling sub-circuit 2 and a light-emitting device OLED. The data writing sub-circuit 1 is connected to a first end of the capacitor C, a second end of the capacitor C is connected to a control electrode of the driving transistor DTFT, a first electrode of the driving transistor DTFT is connected to a first power supply end, a second electrode of the driving transistor DTFT is connected to a first electrode of the light-emitting device OLED, the current controlling sub-circuit 2 is connected to a first electrode of the light-emitting device OLED and a second power supply end, and a second electrode of the light-emitting device OLED is connected to the second power supply end.

During a data writing stage, the data writing sub-circuit 1, under control of a first control signal inputted via a first control signal input line SC_1, writes a data voltage supplied via a data line (Data) into the first end of the capacitor C.

The driving transistor DTFT is used for generating a driving current under control of a voltage at the second end of the capacitor C during a light-emitting stage.

The current controlling sub-circuit 2 is used for controlling a ratio of a total time during which the driving current flows into the current controlling sub-circuit to a total time during which the driving current flows into the light-emitting device OLED under control of a second control signal inputted via a second control signal input line SC_2 during the light-emitting stage in order to control visual brightness of the light-emitting device OLED.

The operation process of the pixel circuit provided by the present embodiment is described in detail below.

During the data writing stage, the data writing sub-circuit 1 inputs a data voltage into the first end of the capacitor C, and at this time, the second end of the capacitor C elevates its voltage to a certain value by a bootstrap effect.

During the light-emitting stage, the driving transistor DTFT generates a driving current, and according to a formula I of saturated driving current for the driving transistor DTFT:

$$I=K^*(\mathrm{Vgs}-\mathrm{Vth})^2$$

$$=K^*(V\mathrm{data}'-\mathrm{Vdd}-\mathrm{Vth})^2$$

wherein K is a constant value, Vgs is a gate source voltage of the driving transistor DTFT, Vth is a threshold voltage of the driving transistor DTFT, Vdd is an operating voltage supplied by the first power supply end, and Vdata' is a voltage at the second end of the capacitor C during the light-emitting stage.

During the entire light-emitting stage, the driving transistor DTFT may constantly output the driving current, whose intensity is constant. According to the present disclosure, the current controlling sub-circuit 2 may control the driving current to flow into the current controlling sub-circuit 2 or into the light-emitting device OLED under control of a second control signal inputted via the second control signal input line SC_2.

In the present embodiment, optionally, the light-emitting stage includes: several light-emitting sub-stages and non-light-emitting sub-stages which are arranged alternately; the current controlling sub-circuit 2 is used for writing a second voltage supplied by the second power supply end into the first electrode of the light-emitting device OLED during the non-light-emitting sub-stages, and at this time, the voltage at the first electrode and that at the second electrode of the light-emitting device OLED (which are both the second voltage) are equal to each other (there is no current between the first electrode and the second electrode of the light-emitting device OLED), and the driving current flows into the current controlling sub-circuit 2.

For example, during the non-light-emitting sub-stages, the driving current flows into the current control sub-circuit 2 and no current flows into the light-emitting device OLED, and thus the light-emitting device OLED does not emit light; during the light-emitting sub-stage, the driving current flows into the light-emitting device OLED, and thus the light-emitting device OLED emits light. During the entire light-emitting stage, a ratio of a total time during which the driving current flows into the current controlling sub-circuit 2 to a total time during which the driving current flows into the light-emitting device OLED is controlled so as to adjust the visual brightness of the light-emitting device OLED.

In the present embodiment, assuming a light-emitting brightness generated by the light-emitting device OLED when the driving current flows into the light-emitting device OLED is L, and a ratio of a total time during which the driving current flows into the current control sub-circuit 2 to a total time during which the driving current flows into the light-emitting device OLED during the light-emitting stage is a:b, the visual brightness of the light-emitting device OLED is $$L' = \frac{b}{a+b} * L.$$

It follows that by controlling the ratio of a total time during which the driving current flows into the current controlling sub-circuit 2 to a total time during which the driving current flows into the light-emitting device OLED during the light-emitting stage, the visual brightness of the light-emitting device OLED can be adjusted.

In the present disclosure, without change of the data voltage, the ratio of a total time during which the driving current flows into the current controlling sub-circuit 2 to a total time during which the driving current flows into the light-emitting device OLED during the light-emitting stage is adjusted so as to adjust the visual brightness of the light-emitting device OLED. Thus, the technical solution of the present disclosure can effectively decrease the amount of Gamma data in the drive chip and increase the data processing speed of the drive chip.

In the present embodiment, optionally, the pixel circuit further includes: a resetting sub-circuit 3, a threshold compensating sub-circuit 4 and a light-emitting controlling sub-circuit 6. The resetting sub-circuit 3 is connected to both the first end and the second end of the capacitor C, the threshold compensating sub-circuit 4 is connected to the second end of the capacitor C and the second electrode of the driving transistor DTFT, and the light-emitting controlling sub-circuit 6 is connected to the second electrode of the driving transistor DTFT and the first electrode of the light-emitting device OLED.

The resetting sub-circuit 3 is used for resetting the first end and the second end of the capacitor C under control of a reset control signal inputted via a reset control signal input line (Reset) during a reset stage.

The threshold compensating sub-circuit 4 is used for writing a sum of a threshold voltage of the driving transistor DTFT and a first voltage supplied by the first power supply end into the second end of the capacitor C under control of the first control signal inputted via the first control signal input line SC_1 during a threshold compensating stage, thereby eliminating the influence on the driving current caused by drift of the threshold voltage of the driving transistor DTFT.

The light-emitting controlling sub-circuit 6 is used for conducting the first electrode of the driving transistor DTFT with the first electrode of the light-emitting device OLED under control of a light-emitting controlling signal inputted via a light-emitting controlling signal input line EM during the light-emitting stage; and for disconnecting the second electrode of the driving transistor DTFT from the first electrode of the light-emitting device OLED during the data writing stage, the threshold compensating stage and the reset stage so as to prevent the driving current from flowing into the light-emitting device OLED to cause erroneous light emission of the light-emitting device OLED.

Optionally, the pixel circuit further includes: a voltage stabilizing sub-circuit 5 which is connected to the first end of the capacitor C; the voltage stabilizing sub-circuit 5 is used for writing a fifth voltage supplied by a fifth power supply end into the first end of the capacitor C under control of a third control signal inputted via a third control signal input line SC_3 during the light-emitting stage so as to keep the voltage at the first end of the capacitor C stable and ensure stability of the voltage at the second end of the capacitor C, thereby effectively ensuring stability of the driving current outputted from the driving transistor DTFT during the light-emitting stage (the intensity of the driving current is constant).

The pixel circuit provided by the exemplary embodiment of the present disclosure may, without change of the data voltage inputted via the data line, adjust, by the current controlling sub-circuit, a ratio of a total time during which the driving current flows into the current controlling sub-circuit to a total time during which the driving current flows into the light-emitting device during the light-emitting stage, thereby adjusting the visual brightness of the light-emitting device. The technical solution of the present disclosure can effectively decrease the amount of Gamma data in the drive chip and increase the data processing speed of the drive chip.

Embodiment II

Figure 2:
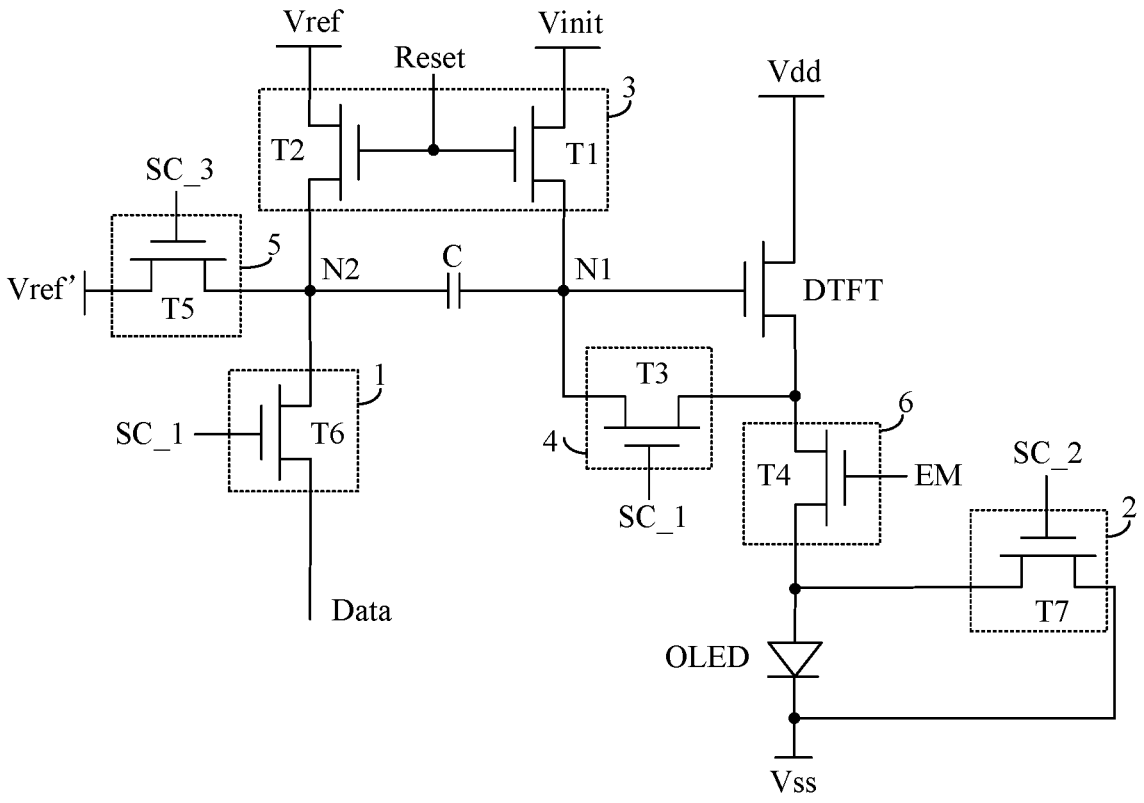
FIG. 2 is a schematic diagram showing a circuit structure of a pixel circuit provided by exemplary embodiments of the present disclosure.

FIG. 2 is a schematic diagram showing a circuit structure of a pixel circuit provided by exemplary embodiments of the present disclosure. As shown in FIG. 2, the pixel circuit is an example of the pixel circuit provided by the above exemplary embodiment. Optionally, the resetting sub-circuit 3 includes: a first transistor T1 and a second transistor T2, wherein a control electrode of the first transistor T1 is connected to the reset control signal input line (Reset), a first electrode of the first transistor T1 is connected to the third power supply end, a second electrode of the first transistor T1 is connected to the second end of the capacitor C, a control electrode of the second transistor T2 is connected to the reset control signal input line (Reset), a first electrode of the second transistor T2 is connected to the fourth power supply end, and a second electrode of the second transistor T2 is connected to the first end of the capacitor C.

Optionally, the threshold compensating sub-circuit 4 includes: a third transistor T3, wherein a control electrode of the third transistor T3 is connected to the first control signal input line SC_1, a first electrode of the third transistor T3 is connected to the second end of the capacitor C, and a second electrode of the third transistor T3 is connected to the second electrode of the driving transistor DTFT.

Optionally, the light-emitting controlling sub-circuit 6 includes: a fourth transistor T4, wherein a control electrode of the fourth transistor T4 is connected to the light-emitting controlling signal input line EM, a first electrode of the fourth transistor T4 is connected to the first electrode of the driving transistor DTFT, and a second electrode of the fourth transistor T4 is conducted with the first electrode of the light-emitting device OLED.

Optionally, the voltage stabilizing sub-circuit 5 includes: a fifth transistor T5, wherein a control electrode of the fifth transistor T5 is connected to the third control signal input line SC_3, a first electrode of the fifth transistor T5 is connected to the fifth power supply end, and a second electrode of the fifth transistor T5 is connected to the first end of the capacitor C.

Optionally, the data writing sub-circuit 1 includes: a sixth transistor T6, wherein a control electrode of the sixth transistor T6 is connected to the first control signal input line SC_1, a first electrode of the sixth transistor T6 is connected to the data line (Data), and a second electrode of the sixth transistor T6 is connected to the first end of the capacitor C.

Optionally, the data writing sub-circuit 1 includes: a sixth transistor T6, wherein a control electrode of the sixth transistor T6 is connected to the first control signal input line SC_1, a first electrode of the sixth transistor T6 is connected to the data line (Data), and a second electrode of the sixth transistor T6 is connected to the first end of the capacitor C.

Optionally, the current controlling sub-circuit 2 includes: a seventh transistor T7, wherein a control electrode of the seventh transistor T7 is connected to the second control signal line, a first electrode of the seventh transistor T7 is connected to the second power supply end, and a second electrode of the seventh transistor T7 is connected to the first electrode of the light-emitting device OLED.

The operation process of the pixel circuit provided by the present embodiment will be described in detail below with reference to the drawings. The first power supply end supplies an operating voltage whose magnitude is Vdd; the second power supply end supplies a ground voltage whose magnitude is Vss; the third power supply end supplies a reset voltage whose magnitude is Vint; the fourth power supply end supplies a reference voltage whose magnitude is Vref; the fifth power supply end supplies a stabilizing voltage whose magnitude is Vref'; the driving transistor DTFT has a threshold voltage of Vth (when the driving transistor is the P-type transistor, Vth is generally a negative value); the data voltage is Vdata.

Figure 3:
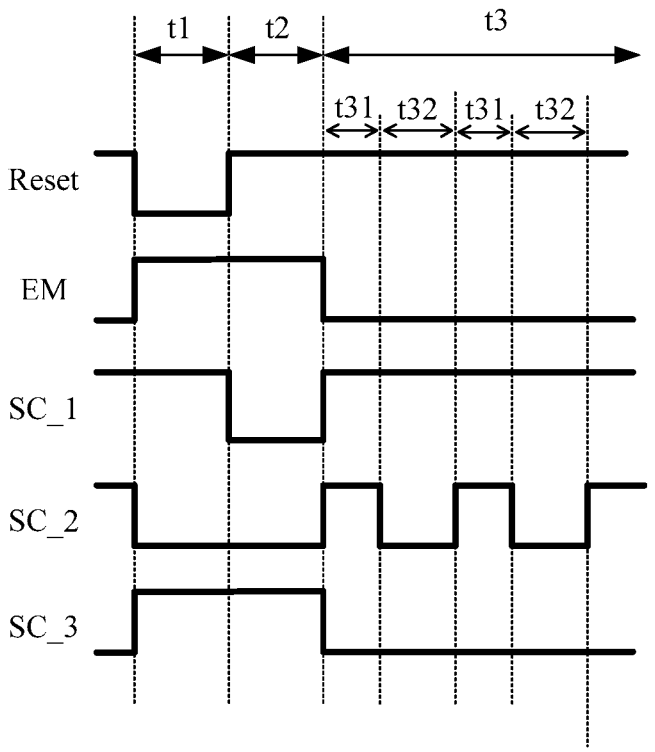
FIG. 3 is a diagram showing a timing sequence for the operations of the pixel circuit as shown in FIG. 2.

FIG. 3 is a diagram showing a timing sequence for the operations of the pixel circuit as shown in FIG. 2. As shown in FIG. 3, the operation process of the pixel circuit includes the following three stages: a reset stage t1, a data writing staging t2 (the threshold compensating stage and the data writing stage occur simultaneously), and a light-emitting stage t3.

During the reset stage t1, the reset control signal in the reset control signal input line (Reset) is at a low level voltage signal, the light-emitting controlling signal in the light-emitting controlling signal input line EM is at a high electrical level, the first control signal in the first control signal input line SC_1 is at a high electrical level, the second control signal in the second control signal input line SC_2 is at a low level voltage signal, and the third control signal in the third control signal input line SC_3 is at a high electrical level.

Since the reset control signal is at a low level voltage signal, both the first transistor T1 and the second transistor T2 are conducted. At this time, the reset voltage is written into the second end of the capacitor C via the first transistor T1, and the voltage at the N1 node is Vint; the reference voltage is written into the first end of the capacitor C via the second transistor T2, and the voltage at the N2 node is Vref.

Although current is outputted from the driving transistor DTFT at this time, since the light-emitting controlling signal is at a high electrical level, the fourth transistor T4 is cut off, so that the current outputted from the driving transistor DTFT cannot pass through the fourth transistor T4.

In addition, in practical application, it is found that although the fourth transistor T4 is cut off, drain current exists in the fourth transistor T4, which drain current would drive the light-emitting device OLED to generate weak light, i.e., the light-emitting OLED has a problem of erroneous light emission. In order to solve this problem, in the present disclosure, the second control signal is controlled to be at a low level voltage signal, such that the seventh transistor T7 is conducted, and the ground voltage is written into the first electrode of the light-emitting device OLED. At this time, the first electrode and the second electrode of the light-emitting device OLED have equal voltages, and the drain current generated in the fourth transistor T4 can only flow out through the seventh transistor T7, but cannot flow toward the light-emitting device OLED, thereby effectively avoiding erroneous light emission of the light-emitting device OLED.

During the data writing stage and threshold compensating stage t2, the reset control signal in the reset control signal input line (Reset) is at a high electrical level, the light-emitting controlling signal in the light-emitting controlling signal input line EM is at a high electrical level, the first control signal in the first control signal input line SC_1 is at a low level voltage signal, the second control signal in the second control signal input line SC_2 is at a low level voltage signal, and the third control signal in the third control signal input line SC_3 is at a high electrical level.

Since the reset control signal is at a high electrical level, both the first transistor T1 and the second transistor T2 are cut off. At the same time, since the first control signal in the first control signal input line SC_1 is at a low level voltage signal, both the third transistor T3 and the sixth transistor T6 are conducted. At this time, the data voltage is written into the first end of the capacitor C via the sixth transistor T6, and a potential at the N2 node is Vdata; and since the third transistor T3 is conducted, the operating voltage starts to charge the N1 node via the driving transistor DTFT and the third transistor T3. When the voltage at the N1 node is charged to Vdd+Vth, the driving transistor DTFT is cut off. At this time, the two ends of the capacitor C have a voltage difference of Vdata−Vdd−Vth.

During charging of the N1 node, although drain current may be generated in the fourth transistor T4, since the seventh transistor T7 is conducted, the drain current may not flow into the light-emitting device OLED, and thus the problem of erroneous light emission of the light-emitting device OLED may not occur at this stage.

During the light-emitting stage t3, the reset control signal in the reset control signal input line (Reset) is at a high electrical level, the light-emitting controlling signal in the light-emitting controlling signal input line EM is at a low level voltage signal, the first control signal in the first control signal input line SC_1 is at a high electrical level, and the third control signal in the third control signal input line SC_3 is at a low level voltage signal.

In the present embodiment, the light-emitting stage t3 includes: several light-emitting sub-stages t31 and non-light-emitting sub-stages t32 which are arranged alternately. During the light-emitting sub-stages t31, the second control signal in the second control signal input line SC_2 is at a high electrical level; during the non-light-emitting sub-stages t32, the second control signal in the second control signal input line SC_2 is at a low level voltage signal.

During the light-emitting sub-stages t31, since the third control signal in the third control signal input line SC_3 is at a low level voltage signal, the fifth transistor T5 is conducted, and the stabilizing voltage Vref' is written into the first end of the capacitor C via the fifth transistor T5, i.e., a voltage at the N2 node is Vref'. At the same time, since the reset control signal in the reset control signal input line (Reset) is at a high electrical level, and the first control signal in the first control signal input line SC_1 is at a high electrical level, both the first transistor T1 and the third transistor T3 are cut off, i.e., the second end of the capacitor C is in a floating state. At this time, the capacitor C may have a bootstrap effect to maintain the voltage difference between the two ends of the capacitor C to be constant, and the voltage at the second end of the capacitor C is hopped to Vdd+Vth+Vref'−Vdata.

According to the Formula I of saturated driving current for the driving transistor DTFT:

$$I=K^*(\mathrm{Vgs}-\mathrm{Vth})^2$$

$$=K^*(\mathrm{Vdd}+\mathrm{Vth}+V\mathrm{ref}'-V\mathrm{data}-\mathrm{Vdd}-\mathrm{Vth})^2$$

$$=K^*(V\mathrm{ref}'-V\mathrm{data})^2$$

It follows that the driving current of the driving transistor DTFT is associated with the stabilizing voltage Vref' supplied by the fifth power supply end and the data voltage Vdata, but is not associated with the threshold voltage Vth of the driving transistor DTFT, so that the driving current flowing through the light-emitting device OLED would not be affected by unevenness and floating of the threshold voltage.

In addition, since the second control signal in the second control signal input line SC_2 is at a high electrical level, the seventh transistor T7 is cut off, the driving current outputted from the driving transistor DTFT flows into the light-emitting device OLED, and the light-emitting device OLED starts to emit light. Under a condition where the data voltage is a constant value, a magnitude of the driving current outputted from the driving transistor DTFT is also a constant value, and at this time, the light-emitting brightness of the light-emitting device OLED under the effect of the driving current can be measured by an experiment in advance.

During the non-light-emitting sub-stages t32, since the second control signal in the second control signal input line SC_2 is at a low level voltage signal, the seventh transistor T7 is conducted, the driving current outputted from the driving transistor DTFT flows out through the seventh transistor T7, and the light-emitting device OLED does not emit light.

During the entire light-emitting stage, by controlling a ratio of a total time during which the driving current flows into the current controlling sub-circuit 2 to a total time during which the driving current flows into the light-emitting device OLED, the visual brightness of the light-emitting device OLED can be adjusted. For example, by controlling a duty cycle of the second control signal, a ratio of a total time during which the driving current flows into the current controlling sub-circuit 2 to a total time during which the driving current flows into the light-emitting device OLED can be controlled.

In order to facilitate the description, it is defined that one light-emitting sub-stage and one non-light-emitting sub-stage form a light-emitting cycle. During a light-emitting sub-stage, the second control signal is at a high electrical level, and during a non-light-emitting sub-stage, the second control signal is at a low level voltage signal. If it is expected that a ratio of a total time during which the driving current flows into the current controlling sub-circuit 2 to a total time during which the driving current flows into the light-emitting device OLED during the entire light-emitting stage would be a:b, a ratio of a time period during which the second control signal is at a low level voltage signal to a time period during which the second control signal is at a high electrical level within one light-emitting cycle may be adjusted to be a:b, and the duty cycle of the second control signal is $$\frac{b}{a+b}.$$

During the entire light-emitting stage, the light-emitting device OLED switches between a light-emitting state and a non-light-emitting state many times. Since the switching frequency is relatively fast, due to persistence of vision of human eyes, the human eyes would perceive that the light-emitting device OLED continuously emits light, i.e., twinkling of the light-emitting device OLED would not be perceived.

In the pixel circuit provided by the present disclosure, the current controlling sub-circuit 2 can not only adjust the visual brightness of the display device but also effectively avoid the problem of erroneous light emission of the display device caused by drain current during the non-light-emitting stages (the reset stage, the data writing stage, and the threshold compensating stage).

During the light-emitting stage t3, the voltage stabilizing sub-circuit 5 continuously writes stabilizing voltage into the first end of the capacitor C in order to stabilize the voltage value at the first end of the capacitor C, such that the voltage value at the second end of the capacitor C is in a stabilized state, and thus the stabilized current can be outputted from the driving transistor DTFT, which facilitates later accurate control of the visual brightness of the display device.

In the present embodiment, preferably, the third control signal input line SC_3 and the light-emitting controlling signal input line EM are the same signal input line, which would reduce the number of signal lines arranged in the pixel circuit. The fifth power supply input end and the fourth power supply input end are the same power supply input end, which would reduce the number of power supply ends in the pixel circuit.

With a consideration that the second control signal for controlling operation of the current controlling sub-circuit 2 needs to have a wide duty cycle adjustment range so as to control the display device to render different viewing angle brightness, in the present embodiment, the second control signal input line SC_2 may be a signal line independent and different from other signal input lines (the reset control signal input line (Reset), the light-emitting controlling signal input line EM, the first control signal input line SC_1, and the third control signal input line SC_3) in the display circuit.

The pixel circuit provided by exemplary embodiments of the present disclosure may, without change of the data voltage inputted via the data line, adjust, by the current controlling sub-circuit, a ratio of a total time during which the driving current flows into the current control sub-circuit to a total time during which the driving current flows into the light-emitting device, in order to adjust the visual brightness of the light-emitting device. The technical solution of the present disclosure can effectively decrease the amount of Gamma data in the drive chip and increase the data processing speed of the drive chip.

Embodiment III

Figure 4:
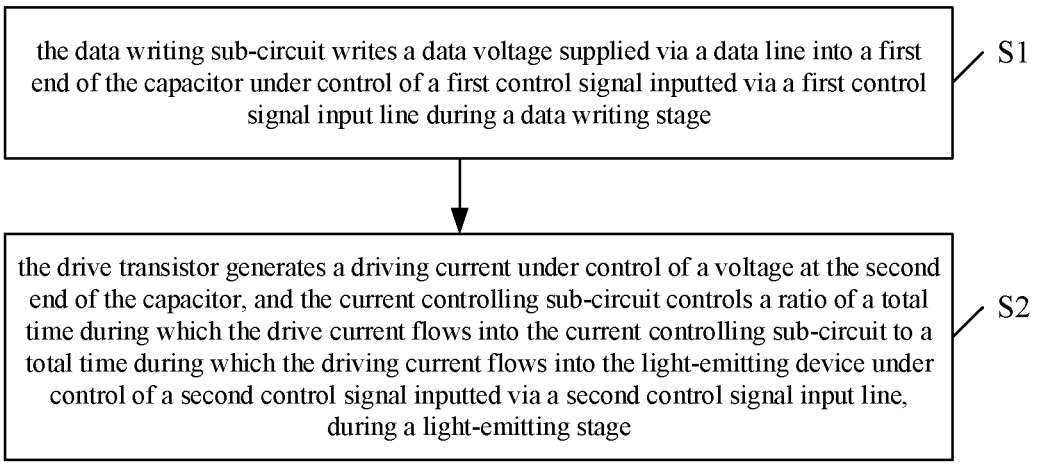
FIG. 4 is a flow chart showing a pixel driving method provided by exemplary embodiments of the present disclosure.

FIG. 4 is a flow chart showing a pixel driving method provided by exemplary embodiments of the present disclosure. As shown in FIG. 4, the pixel driving method is based on the pixel circuit in the above exemplary embodiments. The specific circuit structure is as described in the above exemplary embodiments, which would not be repeated here. The pixel driving method includes:

Step S1, during a data writing stage, a data writing sub-circuit writes a data voltage supplied via a data line into a first end of the capacitor under control of a first control signal inputted via a first control signal input line.

Step S2, during a light-emitting stage, the driving transistor generates a driving current under control of a voltage at a second end of the capacitor; the current controlling sub-circuit controls a ratio of a total time during which the driving current flows into the current controlling sub-circuit to a total time during which the driving current flows into the light-emitting device under control of a second control signal inputted via a second control signal input line.

Optionally, the light-emitting stage includes several light-emitting sub-stages and non-light-emitting sub-stages which are arranged alternately. For example, Step S2 may include:

Step S201, during light-emitting sub-stages in the light-emitting stage, the current controlling sub-circuit disconnects the second power supply end from the first electrode of the light-emitting device under control of a second control signal inputted via the second control signal input line, so that the driving current flows into the light-emitting device and the light-emitting device emits light.

Step S202, during non-light-emitting subs-stages in the light-emitting stage, the current controlling sub-circuit writes the second voltage supplied by the second power supply end into the first electrode of the light-emitting device under control of the second control signal inputted via the second control signal input line, such that the driving current flows into the current controlling sub-circuit to control the light-emitting device not to emit light.

For specific description on the above respective steps, please refer to corresponding content in the above exemplary embodiments, which would not be repeated here.

Embodiment IV

Embodiment IV of the present disclosure provides a display device, which includes the pixel circuit according to the above exemplary embodiments. For specific contents, please refer to the description in the above exemplary embodiments.

For example, the display device provided by the present embodiment may include any product or component having a display function, such as a display panel, a mobile phone, a tablet computer, a television, a display, a notebook computer, a digital photo frame, or a navigator.

It is understandable that the above embodiments are only embodiments employed to illustrate principles of the present disclosure, which would by no means limit the present disclosure. Those skilled in the art may make various variations and modifications without departing from sprits and substance of the present disclosure, and such variations and modifications shall be deemed to fall into the protection scope of the present disclosure.

What is claimed is:

1. A pixel circuit, comprising: a driving transistor, a capacitor, a data writing sub-circuit, a current control sub-circuit and a light-emitting device, wherein:

the data writing sub-circuit is connected to a first end of the capacitor, a second end of the capacitor is connected to a control electrode of the driving transistor, a first electrode of the driving transistor is connected to a first power supply end, a second electrode of the driving transistor is connected to a first electrode of the light-emitting device, the current controlling sub-circuit is connected to the first electrode of the light-emitting device and a second power supply end, and a second electrode of the light-emitting device is connected to the second power supply end;

the data writing sub-circuit is used for writing a data voltage supplied via a data line into the first end of the capacitor under control of a first control signal inputted via a first control signal input line during a data writing stage;

the driving transistor is used for generating a driving current under control of a voltage at the second end of the capacitor during a light-emitting stage;

the current controlling sub-circuit is used for controlling a ratio of a total time during which the driving current flows into the current controlling sub-circuit to a total time during which the driving current flows into the light-emitting device under control of a second control signal inputted via a second control signal input line during the light-emitting stage.

2. The pixel circuit according to claim 1, wherein the light-emitting stage comprises: several light-emitting sub-stages and non-light-emitting sub-stages which are alternately arranged;

wherein the current controlling sub-circuit is used for writing, during the non-light-emitting sub-stages, a second voltage supplied by the second power supply end into the first electrode of the light-emitting device such that the driving current flows into the current controlling sub-circuit.

3. The pixel circuit according to claim 1, further comprising: a resetting sub-circuit which is connected to both the first end and the second end of the capacitor;

wherein the resetting sub-circuit is used for resetting the first end and the second end of the capacitor under control of a reset control signal inputted via a reset control signal input line during a reset stage.

4. The pixel circuit according to claim 3, wherein the resetting sub-circuit comprises: a first transistor and a second transistor;

wherein a control electrode of the first transistor is connected to the reset control signal input line, a first electrode of the first transistor is connected to a third power supply end, and a second electrode of the first transistor is connected to the second end of the capacitor; and wherein a control electrode of the second transistor is connected to the reset control signal input line, a first electrode of the second transistor is connected to a fourth power supply end, and a second electrode of the second transistor is connected to the first end of the capacitor.

5. The pixel circuit according to claim 1, further comprising: a threshold compensating sub-circuit which is connected to the second end of the capacitor and the second electrode of the driving transistor;

wherein the threshold compensating sub-circuit is used for writing a sum of a threshold voltage of the driving transistor and a first voltage supplied by the first power supply end into the second end of the capacitor under control of the first control signal inputted via the first control signal input line during a threshold compensating stage.

6. The pixel circuit according to claim 5, wherein the threshold compensating sub-circuit comprises: a third transistor;

wherein a control electrode of the third transistor is connected to the first control signal input line, a first electrode of the third transistor is connected to the second end of the capacitor, and a second electrode of the third transistor is connected to the second electrode of the driving transistor.

7. The pixel circuit according to claim 1, further comprising: a light-emitting controlling sub-circuit which is provided between the second electrode of the driving transistor and the first electrode of the light-emitting device;

wherein the light-emitting controlling sub-circuit is used for conducting the first electrode of the driving transistor with the first electrode of the light-emitting device under control of a light-emitting controlling signal inputted via a light-emitting controlling signal input line during the light-emitting stage.

8. The pixel circuit according to claim 7, wherein the light-emitting controlling sub-circuit comprises: a fourth transistor;

wherein a control electrode of the fourth transistor is connected to the light-emitting controlling signal input line, a first electrode of the fourth transistor is connected to the first electrode of the driving transistor, and a second electrode of the fourth transistor is conducted with the first electrode of the light-emitting device.

9. The pixel circuit according to claim 1, further comprising: a voltage stabilizing sub-circuit which is connected to the first end of the capacitor;

wherein the voltage stabilizing sub-circuit is used for writing a fifth voltage supplied by a fifth power supply end into the first end of the capacitor under control of a third control signal inputted via a third control signal input line during the light-emitting stage.

10. The pixel circuit according to claim 9, wherein the voltage stabilizing sub-circuit comprises: a fifth transistor;

wherein a control electrode of the fifth transistor is connected to the third control signal input line, a first electrode of the fifth transistor is connected to the fifth power supply end, and a second electrode of the fifth transistor is connected to the first end of the capacitor.

11. The pixel circuit according to claim 1, wherein the data writing sub-circuit comprises: a sixth transistor;

wherein a control electrode of the sixth transistor is connected to the first control signal input line, a first electrode of the sixth transistor is connected to the data line, and a second electrode of the sixth transistor is connected to the first end of the capacitor.

12. The pixel circuit according to claim 1, wherein the current controlling sub-circuit comprises: a seventh transistor;

a control electrode of the seventh transistor is connected to the second control signal line, a first electrode of the seventh transistor is connected to the second power supply end, and a second electrode of the seventh transistor is connected to the first electrode of the light-emitting device.

13. The pixel circuit according to claim 1, wherein the driving transistor is a P-type transistor, the first electrode of the driving transistor is a source electrode of the P-type transistor, and the second electrode of the driving transistor is a drain electrode of the P-type transistor.

14. The pixel circuit according to claim 1, wherein the driving transistor is an N-type transistor, the first electrode of the driving transistor is a drain electrode of the N-type transistor, and the second electrode of the driving transistor is a source electrode of the N-type transistor.

15. The pixel circuit according to claim 1, wherein the light-emitting device is an organic light-emitting diode, the first electrode of the light-emitting device is an anode of the organic light-emitting diode, and the second electrode of the light-emitting device is a cathode of the organic light-emitting diode.

16. The pixel circuit according to claim 1, comprising: a resetting sub-circuit, a threshold compensating sub-circuit, a light-emitting controlling sub-circuit and a voltage stabilizing sub-circuit; wherein:

the resetting sub-circuit comprises a first transistor and a second transistor;

a control electrode of the first transistor is connected to a reset control signal input line, a first electrode of the first transistor is connected to a third power supply end, and a second electrode of the first transistor is connected to a second end of the capacitor;

a control electrode of the second transistor is connected to the reset control signal input line, a first electrode of the second transistor is connected to a fourth power supply end, and a second electrode of the second transistor is connected to a first end of the capacitor;

the threshold compensating sub-circuit comprises a third transistor, wherein a control electrode of the third transistor is connected to the first control signal input line, a first electrode of the third transistor is connected to the second end of the capacitor, and a second electrode of the third transistor is connected to the second electrode of the driving transistor;

the light-emitting controlling sub-circuit comprises a fourth transistor, wherein a control electrode of the fourth transistor is connected to the light-emitting controlling signal input line, a first electrode of the fourth transistor is connected to the first electrode of the driving transistor, and a second electrode of the fourth transistor is conducted with the first electrode of the light-emitting device;

the voltage stabilizing sub-circuit comprises a fifth transistor, wherein a control electrode of the fifth transistor is connected to the third control signal input line, a first electrode of the fifth transistor is connected to the fifth power supply end, and a second electrode of the fifth transistor is connected to the first end of the capacitor;

the data writing sub-circuit comprises a sixth transistor, wherein a control electrode of the sixth transistor is connected to the first control signal input line, a first electrode of the sixth transistor is connected to the data line, and a second electrode of the sixth transistor is connected to the first end of the capacitor;

the current controlling sub-circuit comprises a seventh transistor, wherein a control electrode of the seventh transistor is connected to the second control signal line, a first electrode of the seventh transistor is connected to the second power supply end, and a second electrode of the seventh transistor is connected to the first electrode of the light-emitting device.

17. A pixel driving method, the pixel driving method comprising:

writing, by a data writing sub-circuit, a data voltage supplied via a data line into a first end of a capacitor under control of a first control signal inputted via a first control signal input line during a data writing stage;

generating, by a driving transistor, a driving current under control of a voltage at a second end of the capacitor, and controlling, by the current controlling sub-circuit, a ratio of a total time during which the driving current flows into a current controlling sub-circuit to a total time during which the driving current flows into the light-emitting device under control of a second control signal inputted via a second control signal input line, during a light-emitting stage.

18. The pixel driving method according to claim 17, wherein when the light-emitting stage comprises several light-emitting sub-stages and non-light-emitting sub-stages which are alternately arranged:

during the non-light-emitting sub-stages in the light-emitting stage, the current controlling sub-circuit, under control of the second control signal inputted via the second control signal input line, writes a second voltage supplied by the second power supply end into a first electrode of the light-emitting device, such that the driving current flows into the current controlling sub-circuit so as to control the light-emitting device not to emit light.

19. A display device, comprising: the pixel circuit according to claim 1.

* * * * *